US005698322A

United States Patent [19]

Tsai et al.

[11] Patent Number: 5,698,322

[45] Date of Patent: Dec. 16, 1997

[54] MULTICOMPONENT FIBER

[75] Inventors: Fu-Jya Tsai; Brian Thomas Etzel, both of Appleton, Wis.

[73] Assignee: Kimberly-Clark Worldwide, Inc., Neenah, Wis.

[21] Appl. No.: 759,107

[22] Filed: Dec. 2, 1996

[51] Int. Cl.[6] ..... D01D 1/04; D01D 5/04; D01D 5/084; D01D 5/253; D01F 8/04; D01F 8/14

[52] U.S. Cl. ..... 428/373; 264/172.11; 264/172.14; 264/172.15; 428/374; 428/397; 428/400; 442/362; 442/363; 442/364; 604/370; 604/372

[58] Field of Search ..... 264/172.11, 172.14, 264/172.15; 428/373, 374, 397, 400

[56] References Cited

U.S. PATENT DOCUMENTS

| | | | |
|---|---|---|---|
| 3,531,561 | 9/1970 | Trehu et al. . | |
| 3,792,011 | 2/1974 | Wasserman et al. . | |
| 4,367,070 | 1/1983 | Hayashi et al. | 8/114.6 |
| 4,710,187 | 12/1987 | Boland et al. | 604/385 A |
| 4,762,521 | 8/1988 | Roessler et al. | 604/38 SA |
| 4,770,656 | 9/1988 | Proxmire et al. | 604/393 |
| 4,789,592 | 12/1988 | Taniguchi et al. | 428/373 |
| 4,798,603 | 1/1989 | Meyer et al. | 604/378 |
| 5,057,368 | 10/1991 | Largman et al. | 428/397 |
| 5,069,970 | 12/1991 | Largman et al. | 428/373 |
| 5,108,820 | 4/1992 | Kaneko et al. | 428/198 |
| 5,147,712 | 9/1992 | Miyahara et al. | 428/224 |
| 5,162,153 | 11/1992 | Cook et al. | 428/373 |
| 5,202,178 | 4/1993 | Turner | 428/287 |
| 5,241,066 | 8/1993 | Davis et al. | 540/540 |
| 5,273,596 | 12/1993 | Newkirk | 156/73.2 |
| 5,277,976 | 1/1994 | Hogle et al. | 428/397 |
| 5,336,552 | 8/1994 | Strack et al. | 428/374 |
| 5,382,400 | 1/1995 | Pike et al. | 428/373 |
| 5,508,378 | 4/1996 | Ohara et al. | 528/354 |
| 5,593,778 | 1/1997 | Kondo et al. | 428/373 |

FOREIGN PATENT DOCUMENTS

| | | | |
|---|---|---|---|
| 06 207320 A | 7/1994 | Japan | D01F 8/04 |
| 06 207323 A | 7/1994 | Japan | D01F 8/14 |
| 06 207324 A | 7/1994 | Japan | D01F 8/14 |
| 06 248552 A | 9/1994 | Japan . | |
| 07 133511 A | 5/1995 | Japan | D01F 8/12 |
| H8 134723 | 5/1996 | Japan | D01F 8/14 |

OTHER PUBLICATIONS

Chemical Abstracts 99(8)54963d: Description of Dreizenshtok, G. S., A. E. Gal, E. Ya. Sorokin, and K. E. Perepelkin, "Cellulose Decomposition in the Sintering of Fibers From Poly(tetrafluoroethylene) Dispersions," *Khim. Volokna*, 1983, No. 3, pp. 33–34.

Chemical Abstracts 109(4)24162z: Description of Fedorova. R. G., G. I. Kudryavtsev, Z. G. Oprits, O. V. Troitskaya, O. A. Nikitina, A. I. Smirnova. and I. F. Khudoshev, "Composite Fibers From Polyacrylonitrile–Aromatic Polyamic Acid Blends," *Khim. Volokna*, 1988, No. 2. pp. 11–12.

Chemical Abstracts 88(16)106639x: Description of Fedorova, R. G., G. I. Kudryavtsev, N. V. Yashkova, O. A. Nikitina, M. V. Shablygin, "Structural Thermal Stabilization of Fibers Based on Aromatic and Heterocyclic Polymer Blends," *Prepr.—Mezhdunar. Simp. Khim. Voloknam, 2nd.* 1977, vol. 4, pp. 36–45.

Chemical Abstracts 82(14)87465v: Description of Geleji, Frigyes and Gabor Druzsbaczky, "Bicomponent Fiber Structures on Polypropylene Basis," *J. Polym. Sci. Polym. Symp.*, 1973, vol. No. 42, Pt. 2, pp. 713–716.

Chemical Abstracts 96(10)70305j: Description of Gusev, V.K., Z.D. Tul'guk, and R. A. Milivskaya, "Two–Component Acetate Threads," *Khim. Volokna*, 1981, No. 6, pp. 31–32.

Chemical Abstracts 102(10)80131f: Description of Sagatova, M. Sh., D. Shpil'man, and I. Z. Zakirov, "Structural and Mechanical Properties of Fibers Produced From Mixtures of Polyacrylonitrile and Chlorinated Poly(vinyl chloride)," Deposited Doc., 1984, No. Viniti 939–84, 10 p.

Chemical Abstracts 105(26)228372v: Description of Slizite, G., R. Ziemelis, A. Kaziliunas, and A. Paulausras, "Study of Photochemical Degradation of Articles Produced From Complex Triacetate–Polyamide Fiber," *Nauch. Tr. Vuzov LitSSR. Khimiya i Khim. Tekhnol.*, 1986, No. 27, pp. 98–102.

Chemical Abstracts 106(12)86124k: Description of U, Ju Jui, L. S. Gal'braikh, M. K. Puzdyrev, S. Yu. Kuznetsova, and T. N. Urusova, "Use of a Reactively Dyed Low–Molecular–Weight Polycaproamide For Production of Colored Polypropylene Fibers," *Khim. Volokna*, 1986, No. 6, pp. 22–24.

Chemical Abstracts 96(4)21192m: Description of Zakirov, I. Z., "Effect of Small Amounts of Polymeric Additives on Structural–Mechanical and Thermal Properties of Synthetic Fibers Spun By a Wet Method," *3–i Mezhdunar. Simpoz. po Khim. Voloknam, Kalinin, 1981, Kalinin*, 1981, No. 5, pp. 105–110.

Chemical Abstracts 102(22)186548n: Description of Zakirov, I. Z., M. Sh. Sagatova, and B. E. Geller, "Temperature Transitions in Polyacrylnitrile–Fibroin Mixtures," *Vysokomol. Soedin., Ser. B*, 1985, vol. 27, No. 2, pp. 116–120.

Chemical Abstracts 105(12)99049u: Description of Zhao Delu, Xue Du, Hungtian Wang, Binghe Li, and Yuanze Xu, "Applications of Controlled Degradation in Polypropylene Tape Yarns," *Suliao*, 1986, vol. 15, No. 2, pp. 5–10.

(List continued on next page.)

*Primary Examiner*—James C. Cannon
*Attorney, Agent, or Firm*—John R. Schenian

[57] ABSTRACT

Disclosed are multicomponent fibers wherein at least one component forms an exposed surface on at least a portion of the multicomponent fiber which will permit thermal bonding of the multicomponent fiber to other fibers. The multicomponent fibers comprise two poly(lactic acid) polymers with different L:D ratios which provide biodegradable properties to the multicomponent fiber yet which allow the multicomponent fiber to be easily processed. The multicomponent fiber is useful in making nonwoven structures that may be used in a disposable absorbent product intended for the absorption of fluids such as body fluids.

29 Claims, No Drawings

OTHER PUBLICATIONS

Chemical Abstracts 114(22)209209s: abstract of laid open Japanese patent application JP 3040865.

Chemical Abstracts 119(12)119421d: abstract of laid open Japanese patent application JP 5093316.

Chemical Abstracts 119(12)119422e: abstract of laid open Japanese patent application JP 5093318.

Chemical Abstracts 119(24)252062d: abstract of laid open Japanese patent application JP 5163616.

Chemical Abstracts 120(8)79336s: abstract of laid open Japanese patent application JP 5093317.

Chemical Abstracts 122(2)12043s: abstract of laid open Japanese patent application JP 6212548.

Chemical Abstracts 122(2)12091f: abstract of laid open Japanese patent application JP 6248515.

MULTICOMPONENT FIBER

BACKGROUND OF THE INVENTION

1. Field of the Invention

The present invention relates to a multicomponent fiber. The multicomponent fiber comprises two different poly (lactic acid) polymers which provide biodegradable properties to the multicomponent fiber yet which allow the multicomponent fiber to be easily processed. The multicomponent fiber is useful in making nonwoven structures that may be used in a disposable absorbent product intended for the absorption of fluids such as body fluids.

2. Description of the Related Art

Disposable absorbent products currently find widespread use in many applications. For example, in the infant and child care areas, diapers and training pants have generally replaced reusable cloth absorbent articles. Other typical disposable absorbent products include feminine care products such as sanitary napkins or tampons, adult incontinence products, and health care products such as surgical drapes or wound dressings. A typical disposable absorbent product generally comprises a composite structure including a topsheet, a backsheet, and an absorbent structure between the topsheet and backsheet. These products usually include some type of fastening system for fitting the product onto the wearer.

Disposable absorbent products are typically subjected to one or more liquid insults, such as of water, urine, menses, or blood, during use. As such, the outer cover backsheet materials of the disposable absorbent products are typically made of liquid-insoluble and liquid impermeable materials, such as polypropylene films, that exhibit a sufficient strength and handling capability so that the disposable absorbent product retains its integrity during use by a wearer and does not allow leakage of the liquid insulting the product.

Although current disposable baby diapers and other disposable absorbent products have been generally accepted by the public, these products still have need of improvement in specific areas. For example, many disposable absorbent products can be difficult to dispose of. For example, attempts to flush many disposable absorbent products down a toilet into a sewage system typically lead to blockage of the toilet or pipes connecting the toilet to the sewage system. In particular, the outer cover materials typically used in the disposable absorbent products generally do not disintegrate or disperse when flushed down a toilet so that the disposable absorbent product cannot be disposed of in this way. If the outer cover materials are made very thin in order to reduce the overall bulk of the disposable absorbent product so as to reduce the likelihood of blockage of a toilet or a sewage pipe, then the outer cover material typically will not exhibit sufficient strength to prevent tearing or ripping as the outer cover material is subjected to the stresses of normal use by a wearer.

Furthermore, solid waste disposal is becoming an ever increasing concern throughout the world. As landfills continue to fill up, there has been an increased demand for material source reduction in disposable products, the incorporation of more recyclable and/or degradable components in disposable products, and the design of products that can be disposed of by means other than by incorporation into solid waste disposal facilities such as landfills.

As such, there is a need for new materials that may be used in disposable absorbent products that generally retain their integrity and strength during use, but after such use, the materials may be more efficiently disposed of. For example, the disposable absorbent product may be easily and efficiently disposed of by composting. Alternatively, the disposable absorbent product may be easily and efficiently disposed of to a liquid sewage system wherein the disposable absorbent product is capable of being degraded.

Although degradable monocomponent fibers are known, problems have been encountered with their use. In particular, if a monocomponent fiber is used in a thermal bonding application, in order to make the monocomponent fiber adhesive-like in order to bind with other fibers, the monocomponent fiber would generally need to be subjected to a temperature that is near the melting temperature of the component of the fiber, thereby making the fiber lose much of its integrity during bonding.

Although multicomponent fibers are known, problems have been encountered with their preparation and use. In general, the components of a multicomponent fiber need to be chemically compatible, so that the components effectively adhere to each other, and have similar rheological characteristics, so that the multicomponent fiber exhibits minimum strength and other mechanical and processing properties. At the same time, the different components generally need to exhibit different physical characteristics, such as melting point temperatures, so that the multicomponent fiber may be useful for later processing into nonwoven structures. It has therefore proven to be a challenge to those skilled in the art to combine components that meet these basic processing needs as well as meeting the desire that the entire multicomponent fiber be degradable.

It is therefore an object of the present invention to provide a multicomponent fiber which is readily degradable in the environment.

It is also an object of the present invention to provide a degradable multicomponent fiber which is easily and efficiently prepared and which is suitable for use in preparing nonwoven structures.

SUMMARY OF THE INVENTION

The present invention concerns a multicomponent fiber that is degradable and yet which is easily prepared and readily processable into desired final structures, such as nonwoven structures.

One aspect of the present invention concerns a multicomponent fiber that comprises a first component and a second component.

One embodiment of such a multicomponent fiber comprises:

a. a first component having a melting temperature and comprising a first poly(lactic acid) polymer with a L:D ratio, wherein the first component forms an exposed surface on at least a portion of the multicomponent fiber; and b. a second component having a melting temperature that is at least about 10° C. greater than the melting temperature exhibited by the first component and comprising a second poly(lactic acid) polymer with a L:D ratio that is greater than the L:D ratio exhibited by the first poly(lactic acid) polymer.

In another aspect, the present invention concerns a process for preparing the multicomponent fiber disclosed herein.

One embodiment of such a process comprises:

a. subjecting a first component to a first temperature and a first shear rate, wherein the first component has a melting temperature, exhibits an apparent viscosity value at the first temperature and the first shear rate, and comprises a first poly(lactic acid) polymer with a L:D ratio;

b. subjecting a second component to a second temperature and a second shear rate, wherein the second component has a melting temperature that is at least about 10° C. greater than the melting temperature exhibited by the first component, the second component exhibits an apparent viscosity value at the second temperature and the second shear rate and the difference between the apparent viscosity value of the first component and the apparent viscosity value of the second component is less than about 250 Pascal·seconds, and the second component comprises a second poly(lactic acid) polymer with a L:D ratio that is greater than the L:D ratio exhibited by the first poly(lactic acid) polymer; and c. adhering the first component to the second component to form a multicomponent fiber.

In another aspect, the present invention concerns an nonwoven structure comprising the multicomponent fiber disclosed herein.

One embodiment of such a nonwoven structure is a frontsheet useful in a disposable absorbent product.

DETAILED DESCRIPTION OF THE PREFERRED EMBODIMENTS

The present invention is directed to a multicomponent fiber which includes a first component and a second component. For purposes of illustration only, the present invention will generally be described in terms of a bicomponent fiber comprising only two components. However, it should be understood that the scope of the present invention is meant to include fibers with two or more components. In general, the different components are extruded from separate extruders but spun together to form one fiber. The components are generally arranged in substantially constantly positioned distinct zones across the cross section of the multicomponent fiber and extend continuously along the length of the multicomponent fiber. The configuration of such a multicomponent fiber may be, for example, a sheath/core arrangement wherein one component is substantially surrounded by a second component, a side-by-side arrangement, a "pie" arrangement, or an "islands-in-the-sea" arrangement. Multicomponent fibers are generally taught in U.S. Pat. No. 5,108,820 to Kaneko et al., U.S. Pat. No. 5,336,552 to Strack et al., and U.S. Pat. No. 5,382,400 to Pike et al., hereby incorporated by reference in their entirety. The multicomponent fibers may also have shapes such as those described in U.S. Pat. No. 5,277,976 to Hogle et al., and U.S. Pat. Nos. 5,057,368 and 5,069,970 to Largman et al., hereby incorporated by reference in their entirety, which generally describe fibers with unconventional shapes.

As used herein, the term "fiber" or "fibrous" is meant to refer to a particulate material wherein the length to diameter ratio of such particulate material is greater than about 10. Conversely, a "nonfiber" or "nonfibrous" material is meant to refer to a particulate material wherein the length to diameter ratio of such particulate material is about 10 or less.

The first component in a multicomponent fiber generally provides an exposed surface on at least a portion of the multicomponent fiber which will permit thermal bonding of the multicomponent fiber to other fibers which may be the same or different from the multicomponent fiber of the present invention. As a result, the multicomponent fiber can then be used to form thermally bonded fibrous nonwoven structures such as a nonwoven web. It is generally desired that the first component forms an exposed surface on the multicomponent fiber that is beneficially at least about 25 percent, more beneficially about 40 percent, suitably about 60 percent, more suitably about 80 percent, and up to about 100 percent of the total surface area of the multicomponent fiber. Furthermore, the first component will comprise an amount of the multicomponent fiber that is between greater than 0 to less than 100 weight percent, beneficially between about 5 to about 95 weight percent, more beneficially between about 25 to about 75 weight percent, and suitably between about 40 to about 60 weight percent, wherein the weight percent is based upon the total weight of the first component and the second component present in the multicomponent fiber.

The second component in a multicomponent fiber generally provides strength or rigidity to the multicomponent fiber and, thus, to any nonwoven structure comprising the multicomponent fiber. Such strength or rigidity to the multicomponent fiber is generally achieved by having the second component have a thermal melting temperature greater than the thermal melting temperature of the first component. As a result, when the multicomponent fiber is subjected to an appropriate temperature, typically greater than the melting temperature of the first component but less than the melting temperature of the second component, the first component will melt while the second component will generally maintain its rigid form. The second component will comprise an amount of the multicomponent fiber that is between greater than 0 to less than 100 weight percent, beneficially between about 5 to about 95 weight percent, more beneficially between about 25 to about 75 weight percent, and suitably between about 40 to about 60 weight percent, wherein the weight percent is based upon the total weight of the first component and the second component present in the multicomponent fiber.

In the present invention, it is also desired that both the first component and the second component be biodegradable. As used herein, "biodegradable" is meant to represent that a material degrades from the action of naturally occurring microorganisms such as bacteria, fungi, and algae. As a result, when the multicomponent fiber, either in the form of a fiber or in the form of a nonwoven structure, will be degradable when disposed of to the environment.

It has been discovered that, by using two poly(lactic acid) polymers that have different properties, a multicomponent fiber may be prepared wherein such multicomponent fiber is substantially degradable yet which multicomponent fiber is easily processable and exhibits effective fibrous mechanical properties.

Poly(lactic acid) polymer is generally prepared by the polymerization of lactic acid. However, it will be recognized by one skilled in the art that a chemically equivalent material may also be prepared by the polymerization of lactide. As such, as used herein, the term "poly(lactic acid) polymer" is intended to represent the polymer that is prepared by either the polymerization of lactic acid or lactide.

Lactic acid and lactide are known to be an asymmetrical molecules, having two optical isomers referred to, respectively as the levorotatory (hereinafter referred to as "L") enantiomer and the dextrorotatory (hereinafter referred to as "D") enantiomer. As a result, by polymerizing a particular enantiomer or by using a mixture of the two enantiomers, it is possible to prepare different polymers that are chemically similar yet which have different properties. In particular, it has been found that by modifying the stereochemistry of a poly(lactic acid) polymer, it is possible to control, for example, the melting temperature, melt rheology, and crystallinity of the polymer. By being able to control such properties, and combined with the high chemical compatibility of using two poly(lactic acid) polymers, it is possible to prepare a multicomponent fiber exhibiting desired melt strength, mechanical properties, softness, and processability properties so as to be able to make attenuated, heat set, and crimped fibers.

In the present invention, it is desired that the poly(lactic acid) polymer in the second component of the multicomponent fiber have an L:D ratio that is higher than the L:D ratio of the poly(lactic acid) polymer in the first component. This is because the L:D ratio determines the limits of a polymer's intrinsic crystallinity which in turn generally determines the melting temperature of a polymer. The degree of crystallinity of a poly(lactic acid) polymer is based on the regularity of the polymer backbone and its ability to line up with similarly shaped sections of itself or other chains. If even a relatively small amount of D-enantiomer (of either lactic acid or lactide), such as about 3 to about 4 weight percent, is copolymerized with L-enantiomer (of either lactic acid or lactide), the polymer backbone generally becomes irregularly shaped enough that it cannot line up and orient itself with other backbone segments of pure L-enantiomer polymer. Therefore, the poly(lactic acid) polymer in the first component, comprising more D-enantiomer, will be less crystalline than the poly(lactic acid) polymer in the second component.

Thus, in the multicomponent fiber of the present invention, it is critical that the poly(lactic acid) polymer in the first component comprise more of the D-enantiomer than the poly(lactic acid) polymer in the second component. As such, the poly(lactic acid) polymer in the first component will have an L:D ratio that is less than the L:D ratio exhibited by the poly(lactic acid) polymer in the second component. It is therefore desired that the poly(lactic acid) polymer in the first component have an L:D ratio that is beneficially less than about 100:0, more beneficially less than about 99.5:0.5, suitably less than about 98:2, and more suitably less than about 96:4, and down to about 90:10, wherein the L: D ratio is based on the moles of the L and D monomers used to prepare the poly(lactic acid) polymer in the first component.

It is desired that the first poly(lactic acid) polymer, having a relatively lower L:D ratio, is present in the first component in an amount that is effective for the first component to exhibit desirable melt strength, fiber mechanical strength, and fiber spinning properties. As such, the first poly(lactic acid) polymer is present in the first component in an amount that is beneficially greater than about 50 weight percent, more beneficially greater than about 75 weight percent, suitably greater than about 90 weight percent, more suitably greater than about 95 weight percent, and most suitably about 100 weight percent, wherein all weight percents are based upon the total weight of the first component.

Similarly, it is critical that the poly(lactic acid) polymer in the second component comprise less of the D-enantiomer than the poly(lactic acid) polymer in the first component. As such, the poly(lactic acid) polymer in the second component will have an L:D ratio that is greater than the L:D ratio exhibited by the poly(lactic acid) polymer in the first component. It is, therefore, desired that the poly(lactic acid) polymer in the second component have an L:D ratio that is beneficially at least about 96:4, more beneficially at least about 98:2, suitably at least about 99.5:0.5, and more suitably about 100:0, wherein the L:D ratio is based on the moles of the L and D monomers used to prepare the poly(lactic acid) polymer in the second component.

It is desired that the second poly(lactic acid) polymer, having a relatively higher L:D ratio, is present in the second component in an amount that is effective for the second component to exhibit desirable melt strength, fiber mechanical strength, and fiber spinning properties. As such, the second poly(lactic acid) polymer is present in the second component in an amount that is beneficially greater than about 50 weight percent, more beneficially greater than about 75 weight percent, suitably greater than about 90 weight percent, more suitably greater than about 95 weight percent, and most suitably about 100 weight percent, wherein all weight percents are based upon the total weight of the second component.

While each of the first and second components of the multicomponent fiber of the present invention will substantially comprise the respective poly(lactic acid) polymers, such components are not limited thereto and can include other components not adversely effecting the desired properties of the first and the second components and of the multicomponent fiber. Exemplary materials which could be used as additional components would include, without limitation, pigments, antioxidants, stabilizers, surfactants, waxes, flow promoters, solid solvents, particulates, and materials added to enhance processability of the first and the second components. If such additional materials are included in the components, it is generally desired that such additional components be used in an amount that is beneficially less than about 5 weight percent, more beneficially less than about 3 weight percent, and suitably less than about 1 weight percent, wherein all weight percents are based on the total weight amount of the first or the second components.

It is generally desirable that the second component have a melting or softening temperature that is beneficially at least about 10° C., more beneficially at least about 20° C., and suitably at least about 25° C. greater than the melting or softening temperature of the first component. In general, polymers or polymer blends which are substantially crystalline in nature will either have a specific melting temperature or a very narrow melting or softening temperature range. In contrast, polymers or polymer blends which are less crystalline or, alternatively, more amorphous, in nature will generally have a more broad melting or softening temperature range. It should be noted that a poly(lactic acid) polymer comprising even a relatively small amount of the D enantiomer may not exhibit an intrinsic melting temperature. However, a melting temperature can be induced by exposing the poly(lactic acid) polymer to certain processing conditions. For example, if a fiber comprising the poly(lactic acid) polymer is extruded and drawndown, the fiber becomes oriented in response to the forces exerted on it. Such orientation can induce crystalline formation to the fiber that can be detected, for example, by differential scanning calorimetry methods. For polymers or polymer blends useful in the present invention, the melting temperature can be determined using differential scanning calorimetry methods, such as a method described in the Test Methods section herein.

Although the absolute melting or softening temperatures of the first and second components are generally not as important as the relative comparison between the two temperatures, it is generally desired that the melting or softening temperatures of the first and second components be within a range that is typically encountered in most useful applications. As such, it is generally desired that the melting or softening temperatures of the first and second components each beneficially be between about 25° C. to about 350° C., more beneficially be between about 55° C. to about 300° C., and suitably be between about 100° C. to about 200° C.

It is also desired that the poly(lactic acid) polymers in each of the first and second components exhibit weight average molecular weights that are effective for the first and second components to each exhibit desirable melt strength, fiber mechanical strength, and fiber spinning properties. In general, if the weight average molecular weight of a poly (lactic acid) polymer is too high, this represents that the polymer chains are heavily entangled which may result in that component being difficult to process. Conversely, if the weight average molecular weight of a poly(lactic acid) polymer is too low, this represents that the polymer chains are not entangled enough which may result in that component exhibiting a relatively weak melt strength, making high speed processing very difficult. Thus, both the poly(lactic acid) polymers in each of the first and second component exhibit weight average molecular weights that are beneficially between about 10,000 to about 500,000, more beneficially between about 50,000 to about 400,000, and suitably between about 100,000 to about 300,000. For polymers or polymer blends useful in the present invention, the weight average molecular weight can be determined using a method as described in the Test Methods section herein.

It is also desired that both of the poly(lactic acid) polymers in each of the first and second components exhibit polydispersity index values that are effective for the first and second components to each exhibit desirable melt strength, fiber mechanical strength, and fiber spinning properties. As used herein, "polydispersity index" is meant to represent the value obtained by dividing the weight average molecular weight of a polymer by the number average molecular weight of the polymer. In general, if the polydispersity index value of a component is too high, the component may be difficult to process due to inconsistent processing properties caused by component segments comprising low molecular weight polymers that have lower melt strength properties during spinning. Thus, the poly(lactic acid) polymers in each of the first and second components exhibit polydispersity index values that are beneficially between about 1 to about 10, more beneficially between about 1 to about 4, and suitably between about 1 to about 3. For polymers or polymer blends useful in the present invention, the number average molecular weight can be determined using a method as described in the Test Methods section herein.

It is also desired that the poly(lactic acid) polymers in each of the first and second component exhibit residual monomer percents that are effective for the first and second component to each exhibit desirable melt strength, fiber mechanical strength, and fiber spinning properties. As used herein, "residual monomer percent" is meant to represent the amount of lactic acid or lactide monomer that is unreacted yet which remains entrapped within the structure of the entangled poly(lactic acid) polymers. In general, if the residual monomer percent of a poly(lactic acid) polymer in a component is too high, the component may be difficult to process due to inconsistent processing properties caused by a large amount of monomer vapor being released during processing that cause variations in extrusion pressures. However, a minor amount of residual monomer in a poly (lactic acid) polymer in a component may be beneficial due to such residual monomer functioning as a plasticizer during a spinning process. Thus, the poly(lactic acid) polymers in each of the first and second component exhibit a residual monomer percent that are beneficially less than about 15 percent, more beneficially less than about 10 percent, and suitably less than about 7 percent.

It is also desired that the poly(lactic acid) polymers in each of the first and second components exhibit melt rheologies that am both substantially similar and effective such that the first and second components, when combined, exhibit desirable melt strength, fiber mechanical strength, and fiber spinning properties. The melt rheology of a poly (lactic acid) polymer may be quantified using the apparent viscosity of the poly(lactic acid) polymer and, as used herein, is meant to represent the apparent viscosity of a component at the shear rate and at the temperature at which the component is to be thermally processed as, for example, when the component is processed through a spinneret. Polymers that have substantially different apparent viscosities have been found to not be readily processable. Although it is desired that both the first and second components exhibit apparent viscosities that are substantially similar, it is not critical that such apparent viscosities be identical. Furthermore, it is generally not important as to which of the first or second components has a higher or lower apparent viscosity value. Instead, it is desired that the difference between the apparent viscosity value of the poly(lactic acid) polymer in the first component, measured at the shear rate and at the temperature at which the first component is to be thermally processed, and the apparent viscosity value of the poly(lactic acid) polymer in the second component, measured at the shear rate and at the temperature at which the second component is to be thermally processed, is beneficially less than about 250 Pascal·seconds, more beneficially less than about 150 Pascal·seconds, suitably less than about 100 Pascal·seconds, and more suitably less than about 50 Pascal·seconds.

Typical conditions for thermally processing the first and second components include using a shear rate that is beneficially between about 100 seconds$^{-1}$ to about 10000 seconds$^{-1}$, more beneficially between about 500 seconds$^{-1}$ to about 5000 seconds$^{-1}$, suitably between about 1000 seconds$^{-1}$ to about 2000 seconds$^{-1}$, and most suitably at about 1000 seconds$^{-1}$. Typical conditions for thermally processing the first and second components also include using a temperature that is beneficially between about 100° C. to about 500° C., more beneficially between about 150° C. to about 300° C., and suitably between about 175° C. to about 250° C.

Methods for making multicomponent fibers are well known and need not be described here in detail. To form a multicomponent fiber, generally, at least two polymers are extruded separately and fed to a polymer distribution system where the polymers are introduced into a segmented spinneret plate. The polymers follow separate paths to the fiber spinneret and are combined in a spinneret hole which comprises either at least two concentric circular holes thus providing a sheath/core type fiber or a circular spinneret hole divided along a diameter into at least two parts to provide a side-by-side type fiber. The combined polymer filament is then cooled, solidified, and drawn, generally by a mechanical rolls system, to an intermediate filament diameter and collected. Subsequently, the filament may be "cold drawn" at a temperature below its softening temperature, to the desired finished fiber diameter and crimped or texturized and cut into a desirable fiber length. Multicomponent fibers can be cut into relatively short lengths, such as staple fibers which generally have lengths in the range of about 25 to about 50 millimeters and short-cut fibers which are even shorter and generally have lengths less than about 18 millimeters. See, for example, U.S. Pat. No. 4,789,592 to Taniguchi et al, and U.S. Pat. No. 5,336,552 to Strack et al., both of which are incorporated herein by reference in their entirety.

Poly(lactic acid) polymer is a typical polyester-based material which often undergoes heat shrinkage during downstream thermal processing. The heat-shrinkage mainly occurs due to the thermally-induced chain relaxation of the polymer segments in the amorphous phase and incomplete crystalline phase. To overcome this problem, it is generally desirable to maximize the crystallization of the material before the bonding stage so that the thermal energy goes directly to melting rather than to allow for chain relaxation and reordering of the incomplete crystalline structure. One solution to this problem is to subject the material to a heat-setting treatment. As such, when fibers subjected to heat-setting reach a bonding roll, the fibers won't substantially shrink because such fibers are already fully or highly oriented.

Thus, in one embodiment of the present invention, it is desired that the multicomponent fibers of the present invention undergo heat-setting. It is desired that such heat-setting occur, when the fibers are subjected to a constant strain of at least 5 percent, at a temperature that is beneficially greater than about 50° C., more beneficially greater than about 70° C., and suitably greater than about 90° C. It is generally recommended to use the highest possible heat-setting temperatures while not sacrificing a fiber's processability.

However, too high of a heat-setting temperature as, for example, a temperature close to the melting temperature of the first component of a multicomponent fiber, may reduce the fiber strength and could result in the fiber being hard to handle due to tackiness.

In one embodiment of the present invention, it is desired that the multicomponent fiber exhibit an amount of shrinking, at a temperature of about 70° C., that is beneficially less than about 10 percent, more beneficially less than about 5 percent, suitably less than about 2 percent, and more suitably less than about 1 percent, wherein the amount of shrinking is based upon the difference between the initial and final lengths divided by the initial length multiplied by 100. The method by which the amount of shrinking that a fiber exhibits may be determined is included in the Test Methods section herein.

The multicomponent fibers of the present invention are suited for use in disposable products including disposable absorbent products such as diapers, adult incontinent products, and bed pads; in catamenial devices such as sanitary napkins, and tampons; and other absorbent products such as wipes, bibs, wound dressings, and surgical capes or drapes. Accordingly, in another aspect, the present invention relates to a disposable absorbent product comprising the multicomponent fibers of the present invention.

In one embodiment of the present invention, the multicomponent fibers are formed into a fibrous matrix for incorporation into a disposable absorbent product. A fibrous matrix may take the form of, for example, a fibrous nonwoven web. Fibrous nonwoven webs may be made completely from the multicomponent fibers of the present invention or they may be blended with other fibers. The length of the fibers used may depend on the particular end use contemplated. Where the fibers are to be degraded in water as, for example, in a toilet, it is advantageous if the lengths are maintained at or below about 15 millimeters.

In one embodiment of the present invention, a disposable absorbent product is provided, which disposable absorbent product comprises a liquid-permeable topsheet, a backsheet attached to the liquid-permeable topsheet, and an absorbent structure positioned between the liquid-permeable topsheet and the backsheet, wherein the liquid-permeable topsheet comprises multicomponent fibers of the present invention.

Exemplary disposable absorbent products are generally described in U.S. Pat. No. 4,710,187; U.S. Pat. No. 4,762,521; U.S. Pat. No. 4,770,656; and U.S. Pat. No. 4,798,603; which references are incorporated herein by reference.

Absorbent products and structures according to all aspects of the present invention are generally subjected, during use, to multiple insults of a body liquid. Accordingly, the absorbent products and structures are desirably capable of absorbing multiple insults of body liquids in quantities to which the absorbent products and structures will be exposed during use. The insults are generally separated from one another by a period of time.

TEST PROCEDURES

MELTING TEMPERATURE

The melting temperature of a material was determined using differential scanning calorimetry. A differential scanning calorimeter, available from T. A. Instruments Inc. of New Castle, Del., under the designation Thermal Analyst 2910 Differential Scanning Calorimeter(DSC), which was outfitted with a liquid nitrogen cooling accessory and used in combination with Thermal Analyst 2200 analysis software program, was used for the determination of melting temperatures.

The material samples tested were either in the form of fibers or resin pellets. It is preferred to not handle the material samples directly, but rather to use tweezers and other tools, so as not to introduce anything that would produce erroneous results. The material samples were cut, in the case of fibers, or placed, in the case of resin pellets, into an aluminum pan and weighed to an accuracy of 0.01 mg on an analytical balance. If needed, a lid was crimped over the material sample onto the pan.

The differential scanning calorimeter was calibrated using an indium metal standard and a baseline correction performed, as described in the manual for the differential scanning calorimeter. A material sample was placed into the test chamber of the differential scanning calorimeter for testing and an empty pan is used as a reference. All testing was run with a 55 cubic centimeter/minute nitrogen (industrial grade) purge on the test chamber. The heating and cooling program is a 2 cycle test that begins with equilibration of the chamber to −75° C., followed by a heating cycle of 20° C./minute to 220° C., followed by a cooling cycle at 20° C./minute to −75° C., and then another heating cycle of 20° C./minute to 220° C.

The results were evaluated using the analysis software program wherein the glass transition temperature (Tg) of inflection, endothermic and exothermic peaks were identified and quantified. The glass transition temperature was identified as the area on the line where a distinct change in slope occurs and then the melting temperature is determined using an automatic inflection calculation.

APPARENT VISCOSITY

A capillary rheometer, available from Göttfert of Rock Hill, S.C., under the designation Göttfert Rheograph 2003 capillary rheometer, which was used in combination with WinRHEO (version 2.31) analysis software, was used to evaluate the apparent viscosity rheological properties of material samples. The capillary rheometer setup included a 2000 bar pressure transducer and a 30/1:0/180 round hole capillary die.

If the material sample being tested demonstrates or is known to have water sensitivity, the material sample is dried in a vacuum oven above its glass transition temperature, i.e. above 55° or 60° C. for poly(lactic acid) materials, under a vacuum of at least 15 inches of mercury with a nitrogen gas purge of at least 30 standard cubic feet per hour (SCFH) for at least 16 hours.

Once the instrument is warmed up and the pressure transducer is calibrated, the material sample is loaded incrementally into the column, packing resin into the column with a ramrod each time to ensure a consistent melt during testing. After material sample loading, a 2 minute melt time precedes each test to allow the material sample to completely melt at the test temperature. The capillary rheometer takes data points automatically and determines the apparent viscosity (in Pascal·second) at 7 apparent shear rates (second$^{-1}$): 50, 100,200, 500, 1000, 2000, and 5000. When examining the resultant curve it is important that the curve be relatively smooth. If there are significant deviations from a general curve from one point to another, possibly due to air in the column, the test run should be repeated to confirm the results.

The resultant rheology curve of apparent shear rate versus apparent viscosity gives an indication of how the material sample will run at that temperature in an extrusion process. The apparent viscosity values at a shear rate of at least 1000 second$^{-1}$ are of specific interest because these are the typical conditions found in commercial fiber spinning extruders.

MOLECULAR WEIGHT

A gas permeation chromatography (GPC) method is used to determine the molecular weight distribution of samples of poly(lactic acid) whose weight average molecular weight ($M_w$) is between 800 to 400,000.

The GPC is setup with two PLgel Mixed K linear 5 micron, 7.5×300 millimeter analytical columns in series. The column and detector temperatures are 30° C. The mobile phase is HPLC grade tetrahydrofuran(THF). The pump rate is 0.8 milliliter per minute with an injection volume of 25 microliters. Total run time is 30 minutes. It is important to note that new analytical columns must be installed every 4 months, a new guard column every month, and a new in-line filter every month.

Standards of polystyrene polymers, obtained from Aldrich Chemical Co., should be mixed into solvent of dichloromethane(DCM):THF (10:90), both HPLC grade, in order to obtain 1 mg/mL concentrations. Multiple polystyrene standards can be combined in one standard solution provided that their peaks do not overlap when chromatographed. A range of standards of about 687 to 400,000 molecular weight should be prepared. Examples of standard mixtures with Aldrich polystyrenes of varying weight average molecular weights include: Standard 1 (401,340; 32,660; 2,727), Standard 2 (45,730; 4,075), Standard 3 (95,800; 12,860) and Standard 4 (184,200; 24,150; 687).

Next, prepare the stock check standard. Dissolve 10 g of a 200,000 molecular weight poly(lactic add) standard, Catalog#19245 obtained from Polysciences Inc., to 100 ml of HPLC grade DCM to a glass jar with a lined lid using an orbital shaker (at least 30 minutes). Pour out the mixture onto a clean, dry, glass plate and first allow the solvent to evaporate, then place in a 35° C. preheated vacuum oven and dry for about 14 hours under a vacuum of 25 mm of mercury. Next, remove the poly(lactic acid) from the oven and cut the film into small strips. Immediately grind the samples using a grinding mill (with a 10 mesh screen) taking care not to add too much sample and causing the grinder to freeze up. Store a few grams of the ground sample in a dry glass jar in a dessicator, while the remainder of the sample can be stored in the freezer in a similar type jar.

It is important to prepare a new check standard prior to the beginning of each new sequence and, because the molecular weight is greatly affected by sample concentration, great care should be taken in its weighing and preparation. To prepare the check standard weigh out 0.0800 g±0.0025 g of 200,000 weight average molecular weight poly(lactic acid) reference standard into a clean dry scintillation vial. Then using a volumetric pipet or dedicated repipet, add 2 ml of DCM to the vial and screw the cap on tightly. Allow the sample to dissolve completely. Swirl the sample on an orbital shaker, such as a Thermolyne Roto Mix (type 51300) or similar mixer, if necessary. To evaluate whether is it dissolved hold the vial up to the light at a 45° angle. Turn it slowly and watch the liquid as it flows down the glass. If the bottom of the vial does not appear smooth, the sample is not completely dissolved. It may take the sample several hours to dissolve. Once dissolved, add 18 ml of THF using a volumetric pipet or dedicated repipet, cap the vial tightly and mix.

Sample preparations begins by weighing 0.0800 g±0.0025 g of the sample into a clean, dry scintillation vial (great care should also be taken in its weighing and preparation). Add 2 ml of DCM to the vial with a volumetric pipet or dedicated repipet and screw the cap on tightly. Allow the sample to dissolve completely using the same technique described in the check standard preparation above. Then add 18 ml of THF using a volumetric pipet or dedicated repipet, cap the vial tightly and mix.

Begin the evaluation by making a test injection of a standard preparation to test the system equilibration. Once equilibration is confirmed inject the standard preparations. After those are run, inject the check standard preparation. Then the sample preparations. Inject the check standard preparation after every 7 sample injections and at the end of testing. Be sure not to take any more than two injections from any one vial, and those two injections must be made within 4.5 hours of each other.

There are 4 quality control parameters to assess the results. First, the correlation coefficient of the fourth order regression calculated for each standard should be not less than 0.950 and not more than 1.050. Second, the relative standard deviation of all the weight average molecular weights of the check standard preparations should not be more than 5.0 percent. Third, the average of the weight average molecular weights of the check standard preparation injections should be within 10 percent of the weight average molecular weight on the first check standard preparation injection. Lastly, record the lactide response for the 200 microgram per milliliter (μg/mL) standard injection on a SQC data chad. Using the chart's control lines, the response must be within the defined SQC parameters.

Calculate the Molecular statistics based on the calibration curve generated from the polystyrene standard preparations and constants for poly(lactic acid) and polystyrene in THF at 30° C. Those are: Polystyrene ($K=14.1^*10^5$, alpha=0.700) and poly(lactic acid) ($K=54.9^*10^5$, alpha=0.639).

PERCENTAGE RESIDUAL LACTIC ACID MONOMER

A gas chromatographic (GC) method is used for the analysis of lactide monomer in solid poly(lactic acid) samples. Samples must be of sufficient molecular weight for the poly(lactic acid) to precipitate out of the methylene chloride/isopropanol solution.

The equipment setup includes a HP5890A gas chromatograph with flame ionization detector(FID), a HP 7673A autosampler, and a HP3393A integrator. The analytical column used is a Restek Trx-5, 30 meters, 0.32 mm inner diameter, 1.0 micron film thickness. The compressed carrier gases should be Helium, 4.5 grade; Hydrogen, zero grade; Air, zero grade. The Helium is set at 8 psig, with a set linear velocity of ≧20 cm per sec at 100° C., purified with molecular sieve and OM-1 nanochem resin traps. Injector B is set at 300° C., the glass liner is a cup splitter design, deactivated with dimethyldichlorosilane, the septum purge is 4 mL/minute and the split flow is 70 mL/minute. Detector B (FID) is set at 305° C., with a hydrogen flow of 30 mL/minute, no purifier trap, an air flow of 400 mL/minute with molecular sieve S trap, and the helium makeup gas (purified from carrier supply) 25 mL/minute. The test method for the oven is as follows: Initial temperature is 100° C. at time=0 minutes. The first heating rate is 3° C./minute to 135° C. to final time=3 minutes. The next ramp is 50° C./minute to 300° C. to final time=5 minutes. The total run time is 22.97 minutes with a 0.5 minute equilibration time. The integrator is set at a chart speed of 1.0 cm/minute, the attenuation(ATTN) is $2^{-3}$. The AR rejection is set at 50. The threshold(THRSH) is −4 and the peak WD is 0.04. The autosampler setup: INET sampler control is Yes; Inj/Bottle=1; # sample washes=5;# pumps=5; Viscosity=1; Volume=1; # of solvent A washes=2; # of solvent B washes=2; Priority sample=0; capillary on-column=0.

New standard solutions should be prepared weekly and stored in a low head space vial, refrigerated at 4° C. Begin by carefully weighing 0.200 g±0.0100 g of lactide reference standard on weighing paper. Quantitatively transfer into a 100 mL volumetric flask, add about 10 mL acetonitrile and mix. Fill flask one-half full with isopropanol (must have greater than 150 ppm water and be GC or other high purity grade) and allow the solution to come to room temperature and for the inside surfaces of the flask to dry. Then dilute to volume with isopropanol and mix. Use the table below to prepare working standards.

| Concentration (μg/mL) | Aliquot (mL) | Volumetric flask (mL) |
|---|---|---|
| 20 | 1 | 100 |
| 40 | 2 | 100 |
| 100 | 5 | 100 |
| 200 | 5 | 50 |
| 400 | 5 | 25 |
| 1000 | 5 | 10 |

Accurately pipet the specified aliquot of lactide stock standard from above into the specified volumetric flask, dilute to volume with isopropanol and mix. Fill snap-cap type GC vials only ½ full and cap with a silicone rubber septum.

Sample preparation begins by weighing out 1.000 g±0.0050 g of poly(lactic acid) sample into a tared scintillation vial. Pipet 7 ml of methylene chloride into the vial and replace the cap tightly, then let the poly(lactic acid) dissolve completely. Pipet in 14.00 ml of isopropanol into the vial by slowly adding down the side of the vial. Replace cap and precipitate the poly(lactic acid) by shaking the vial vigorously. Let the vial stand 10 minutes to allow complete poly(lactic acid) precipitation and to allow the precipitate to settle. Next, using a syringe and a 0.45 micron GHP Acro-Disc syringe filter, filter a few mL of the supernatant into a clean scintillation vial. Pipet 2.00 mL of the filtered supernatant into a clean, dry 10 mL volumetric flask. Dilute to volume with isopropanol and mix. Lastly, using a syringe (with 0.45 micron GHP AcroDisc syringe filter), filter about 1 mL of the diluted supernatant into a clean snap-cap type GC vial so the vial is only ½ full and cap with a silicone rubber septum.

Begin testing by injecting an isopropanol blank. Next, inject the standard preparations, using the 20 μg/mL standard first and ending with the 2000 μg/mL standard. Inject the sample preparations (inject at least 10 percent of these in duplicate). Be sure to inject the 400 μg/mL standard from a fresh vial as a check standard after every duplicate sample preparation injection and at the end of the sequence.

Quality control parameters include: 1) the lactide result for each check standard injection should be within the range of the true value ±10 percent; 2) the correlation coefficient of the linear regression calculated for the concentrations versus area for the standard preparation injections must not be less that 0.990; 3) the lactide result from duplicate injections of at least 10 percent of all sample preparations tested should be within 10 percent of each other; 4) record the lactide response for the 200 μg/mL standard injection on a SQC data chart. Using the charts control lines, the response must be within the defined SQC parameters.

Resultant calculations begin by constructing a calibration curve for the lactide standards and performing a linear regression of the concentration versus area response data. Calculate the μg of analyte per mL using the area plugged into the equation for the line obtained from the slope and intercept from the linear regression. Then calculate the lactide in the sample preparation using the result from the linear regression in the following equation: μg residual lactide per gram poly(lactic acid) sample=μg lactide/mL in prep divided by weight(g) of sample multiplied by 21 mL multiplied by 10 mL and divided by 2 mL.

L:D STEREOISOMER RATIO

A high pressure liquid chromatograph (HPLC) procedure is used for the determination of the concentrations of D-enantiomer and L-enantiomer lactic acid in solid poly (lactic acid), to an accuracy of 0.1 percent D-enantiomer lactic acid. The HPLC is setup with a Chiral penicillamine analytical column and diode array or variable wavelength detector set at 238 nanometers(nm). In sample preparation HPLC grade water is used.

A system suitability standard is prepared by dissolving 0.2000 g (±0.1000 g) of a D-L lactic acid syrup (85 percent aqueous solution containing approximately equal amounts of each isomer) in 100 ml water. Next, a quality control standard is made by dissolving 2.2000 g (±0.1000 g)of L-lactic acid crystals, available from Fluka Inc., greater than 99 percent crystalline, and 0.0600 g (±0.1000 g) of D-L lactic acid syrup (85 percent aqueous solution) to a 100 ml volumetric flask.

Test samples are prepared by combining 2.20 g (±0.05 g) of solid resin sample with 1.40 g (±0.02 g) reagent grade sodium hydroxide (NaOH) and 50–70ml of water in a refluxing flask and refluxing until all polymer is consumed which usually takes about 3 hours. Rinse the condenser down after reflux is complete, detach it, and allow the flask to cool to room temperature. Test the solution's pH and adjust it to a pH of 4 to 7 with sulfuric acid ($H_2SO_4$). Transfer the adjusted solution to a 100 ml volumetric flask, being sure to rinse sample flask thoroughly with water, and dilute to 100 ml with water and mix. If sample preparation is cloudy, filter a portion through a syringe filter such as a Gelman Acrodisk CR (0.45 micron PTFE) or equivalent.

The experimental method begins by injecting the system suitability standard to insure system equilibration. The quality control standard should be injected at the beginning and end of every sequence and after every five sample preparation injections. Once ready, inject the sample preparations. Then inject the system suitability standard at the end of the sequence. After all samples have been analyzed, wash the column at 0.2 to 0.5 milliliters per minute for several hours with a clean-up mobile phase.

The final calculations are based on the area of the peaks produced by the HPLC. The approximate retention times are: 20–24 minutes for the D isomer and 24–30 minutes for the L isomer. The resolution(R) is 2 times $[(Rt_{L(+)}-Rt_{D(-)})/[(W_{D(-)}/W_{L(+)}]$, where W is the corrected peak width at the baseline in minutes and Rt is the retention time in minutes. The number of theoretical plates(N) is 16 times $(Rt/W)^2$. The percent D lactic acid is calculated as the area of the D lactic acid peak divided by the combined area of the L lactic acid and D lactic acid peak with the result then multiplied by 100.

SHRINKING OF FIBERS

The required equipment for the determination of heat shrinkage include: a convection oven (Thelco model 160 DM laboratory oven), 0.5 g (+/–0.06 g) sinker weights, ½ inch binder clips, masking tape, graph paper with at least ¼ inch squares, foam posterboard (11 by 14 inches) or equivalent substrate to attach the graph paper and samples. The convection oven should be capable of a temperature of 100° C.

Fiber samples are melt spun at their respective spinning conditions, a 30 filament bundle is preferred, and mechanically drawn to obtain fibers with a jetstretch of 224 or higher. Only fibers of the same jetstretch can be compared to one another in regards to their heat shrinkage. The jetstretch of a fiber is the ratio of the speed of the drawdown roll divided by the linear extrusion rate (distance/time) of the melted polymer exiting the spinneret. The spun fiber is usually collected onto a bobbin using a winder. The collected fiber bundle is separated into 30 filaments, if a 30 filament bundle has not already been obtained, and cut into 9 inch lengths.

The graph paper is taped onto the posterboard where one edge of the graph paper is matched with the edge of the posterboard. One end of the fiber bundle is taped, no more than the end 1 inch. The taped end is clipped to the posterboard at the edge where the graph paper is matched up such that the edge of the clip rests over one of the horizontal lines on the graph paper while holding the fiber bundle in place (the taped end should be barely visible as it's secured under the clip). The other end of the bundle is pulled taught and lined up parallel to the vertical lines on the graph paper. Next, at 7 inches down from the point where the clip is binding the fiber pinch the 0.5 g sinker around the fiber bundle. Repeat the attachment process for each replicate. Usually, 3 replicates can be attached at one time. Marks can be made on the graph paper to indicate the initial positions of the sinkers. The samples are placed into the 100° C. oven such that they hang vertically and do not touch the posterboard. At time intervals of 5, 10 and 15 minutes quickly mark the new location of the sinkers on the graph paper and return samples to the oven.

After the testing is complete remove the posterboard and measure the distances between the origin (where the clip held the fibers) and the marks at 5, 10 and 15 minutes with a ruler graduated to 1/16 inch. Three replicates per sample is recommended. Calculate averages, standard deviations and percent shrinkage. The percent shrinkage is calculated as (initial length–measured length) divided by the initial length and multiplied by 100.

EXAMPLES

Various materials were used as components to form multicomponent fibers in the following Examples. The designation and various properties of these materials are listed in Table 1. Apparent viscosity data for several of these materials are summarized in Table 2.

Samples 1–6 are poly(lactic acid) polymers obtained from Chronopol Inc., Golden, Col.

A poly(lactic acid) polymer was obtained from Cargill Inc. of Wayzala, Minn., under the designation Cargill-6902 Polylactide.

A poly(lactic acid) polymer was obtained from Aldrich Chemical Company Inc. of Milwaukee, Wis., under the designation Polylactide, catalog #43,232–6.

A polybutylene succinate, available from Showa Highpolymer Co., Ltd., Tokyo, Japan, under the designation Bionolle 1020, was obtained.

A polybutylene succinate-co-adipate, available from Showa Highpolymer Co., Ltd., Tokyo, Japan, under the designation Bionolle 3020, was obtained.

A polyhydroxybutyrate-co-valerate, available from Zeneca Bio-Products Inc., Wilmington, Del., under the designation Biopol 600G, was obtained.

TABLE 1

| Material Designation | L:D Ratio | Melting Temp. (°C.) | Weight Average Molecular Weight | Number Average Molecular Weight | Poly-disp-ersity Index | Resi-dual Lactic Acid Mono-mer |
|---|---|---|---|---|---|---|
| Sample 1 | 100:0 | 175 | 211,000 | 127,000 | 1.66 | 5.5% |
| Sample 2 | 95:5 | ~140 | 188,000 | 108,000 | 1.74 | 4.8% |
| Sample 3 | 100:0 | 175 | 184,000 | 95,000 | 1.94 | 1.5% |
| Sample 4 | 95:5 | ~140 | 140,000 | 73,000 | 1.92 | 3.4% |
| Sample 5 | 100:0 | 175 | 181,000 | 115,000 | 1.57 | 2.3% |
| Sample 6 | 95:5 | ~140 | 166,000 | 102,000 | 1.63 | 2.3% |
| Cargill 6902 | 94:6 | ~140 | 151,000 | — | — | — |
| Aldrich PLA 43,232-6 | 94:6 | ~140 | 144,000 | 60,000 | 2.4 | — |
| Bionolle 1020 | N/A | 114 | — | — | — | N/A |
| Bionolle 3020 | N/A | 95 | — | — | — | N/A |
| Biopol 600G | N/A | 149, 161 | — | — | — | N/A |

TABLE 2

Viscosity (Pa*s) at 180° C.

| shear rate (1/s) | Sample 6 | Sample 2 |
|---|---|---|
| 50 | 342 | 114 |
| 100 | 252.4 | 81.4 |
| 200 | 232.1 | 81.4 |
| 500 | 153.1 | 70 |
| 1000 | 119.7 | 65.1 |
| 2000 | 87.5 | 52.5 |
| 5000 | 51.5 | 34.2 |

Viscosity (Pa*s) at 190° C.

| shear rate (1/s) | Sample 5 | Sample 6 | Sample 2 |
|---|---|---|---|
| 50 | 863.1 | 293.1 | 130.3 |
| 100 | 594.4 | 195.4 | 146.6 |
| 200 | 415.3 | 166.9 | 126.2 |
| 500 | 333.9 | 127 | 81.4 |
| 1000 | 223.1 | 105 | 67.6 |
| 2000 | 141.1 | 79.8 | 52.9 |
| 5000 | 71.2 | 47.1 | 34.5 |

Viscosity (Pa*s) at 195° C.

| shear rate (1/s) | Aldrich PLA | Sample 5 | Sample 6 | Sample 2 | Cargill 6092 |
|---|---|---|---|---|---|
| 50 | 81.4 | 374.6 | 407.1 | 48.9 | 276.9 |
| 100 | 57 | 293.1 | 309.4 | 44.8 | 195.4 |
| 200 | 48.9 | 256.5 | 276.9 | 52.9 | 162.9 |
| 500 | 40.7 | 198.7 | 229.6 | 51.3 | 123.8 |
| 1000 | 36.6 | 153.9 | 165.3 | 46 | 96.1 |
| 2000 | 37.8 | 107.9 | 116.4 | 39.3 | 70.8 |
| 5000 | 23.8 | 59.9 | 61.2 | 28.8 | 43.2 |

Viscosity (Pa*s) at 200° C.

| shear rate (1/s) | Sample 5 | Sample 1 | Cargill 6902 |
|---|---|---|---|
| 50 | 228 | 1091.1 | 162.9 |
| 100 | 203.6 | 912 | 122.1 |
| 200 | 158.8 | 659.5 | 105.9 |
| 500 | 136.8 | 400.6 | 86.3 |
| 1000 | 111.5 | 268.7 | 72.5 |
| 2000 | 87.5 | 153.9 | 56.6 |
| 5000 | 51 | 79.6 | 35.7 |

Viscosity (Pa*s)

| shear rate (1/s) | Bionolle 1020 (218° C.) | Cargill 6902 (221° C.) |
|---|---|---|
| 50 | 65.1 | 16.3 |
| 100 | 89.6 | 24.4 |
| 200 | 97.7 | 24.4 |
| 500 | 101 | 27.7 |
| 1000 | 97.7 | 25.2 |
| 2000 | 74.9 | 22.8 |
| 5000 | 51.1 | 18.2 |

EXAMPLES 1–10

The extruders used each have ¾ inch diameter, 24:1 (length:diameter) screws and have 3 heating zones. There is a transfer pipe from the extruder to the spin pack which constitutes the 4th heating zone. Then the 5th zone is the spin pack which uses a 16 hole (0.6 mm diameter holes) spinneret to produce fibers. The temperatures of these 5 zones are indicated sequentially on Table 3 under the heading of Extruder Temps. No finishing agents were used to prepare these multicomponent fibers. The resulting fibers were collected through an air powered fiber drawing unit in order to try to form nonwoven materials. The materials used for each example, the process conditions used, and the quality of the nonwoven material collected, if any, are summarized in Table 3.

TABLE 3

| Sample | | Polymers | % of Fiber X-section | Extruder Temps (°C.) | Comments |
|---|---|---|---|---|---|
| *Case 1 | Core | Cargill6902 | 50 | 177/216/221/211/207 | Forms fibers, but melt strength too low to be drawn into the fiber drawing unit |
| | Sheath | Bionolle #3020 | 50 | 149/204/216/211/210 | |
| *Case 2 | Core | Cargill6902 | 50 | 149/204/216/221/207 | Fibers can't be attenuated because of poor melt strength |
| | Sheath | Bionolle #1020 | 50 | 177/216/221/211/209 | |
| *Case 3 | Core | Cargill6902/Bionolle 1020(50:50) | 50 | 182/204216/221/217 | Unable to form fibers; melt dripping out of die. |
| | Sheath | Bionolle #1020 | 50 | 149/210/216/216/214 | |
| *Case 4 | Core | Cargill6902 | 50 | 182/204/216/221/221 | Poor melt strength and fibers stick together |
| | Sheath | Bionolle #1020 | 50 | 149/210/216/216/218 | |
| *Case 5 | Core | Biopol 600G | 70 | 182/199/207/212/200 | Poor melt strength. Developed high extruder pressures |
| | Sheath | Bionolle #1020 | 30 | 149/210/221/217/216 | |
| *Case 6 | Core | Cargill6902/Biopol 600G(50:50) | 50 | 181/208/213/219/204 | Poor melt strength. Developed high extruder pressures |
| | Sheath | Bionolle #1020 | 50 | 149/210/221/217/215 | |
| Case 7 | Core | Sample 1 | 60 | 154/199/199/199/199 | PLA-based fibers with matched rheology |
| | Sheath | Sample 2 | 40 | 149/185/188/188/188 | |
| Case 8 | Segment 1 | Sample 1 | 70 | 171/199/202/201/201 | PLA-based segmented pie with matched rheology |
| | Segment 2 | Sample 2 | 30 | 149/188/188/188/188 | |
| Case 9 | Core | Sample 1 | 50 | 170/193/193/193/199 | PLA-based fibers with matched rheology |
| | Sheath | Cargill 6902 | 50 | 182/195/182/182/193 | |
| Case 10 | Core | Sample 1 | 50 | 171/193/193/193/199 | PLA-based fibers with matched rheology |
| | Sheath | Aldrich PLA (43,232-6) | 50 | 182/195/182/182/193 | |

EXAMPLE 11

The extruder set up is similar to that used in Examples 1–10. A 621H spinneret and 0.6 percent aqueous solution of Chisso P type finishing agent were used in this trial. Bicomponent fibers of about 4 denier per filament composed of Sample 3 as the core and Sample 4 as the sheath were spun, heat set on 60° C. rolls and at 90° C. in dryer, crimped and then cut into staple and short-cut fibers. The drawn fibers had a fiber tenacity of 1.98 gram/denier and an elongation of 80 percent. The materials used for each example, the process conditions used, and the quality of the fibers collected, are summarized in Table 4.

EXAMPLE 12

Bicomponent fibers with core/sheath structure were prepared with Sample 3 as the core and Sample 4 as the sheath. The extruder setup is similar to that used in Example 1–10 except there is no transfer pipe. Rather, the extruder feeds directly into the spin pack. A 288 hole (0.35 mm diameter holes) spinneret was used. A 12 percent (by weight) aqueous solution of Lurol PS-6004 (Goulston Technology) finishing agent was used. The drawdown roll ran at 1070 meter/minute while the speed of the kiss roll for finishing was 130 meter/minute. The resulting fiber has an elongation of 84 percent and a tenacity of 1.5 gram per denier for a 2.7 denier fiber. The fiber was collected onto a bobbin and then cut into short fibers of 1.5 and 0.25 inches long. These fibers were then converted into bonded carded web nonwoven. The materials used, the process conditions used, and the quality of the fibers collected, are summarized in Table 4.

TABLE 4

| | | | | | |
|---|---|---|---|---|---|
| Case 11 | Core | Sample 3 | 50 | 185/215/215/200/200 | PLA-based matched rheology fibers with heat-setting |
| | Sheath | Sample 4 | 50 | 160/200/200/200/200 | |
| Case 12 | Core | Sample 3 | 50 | 155/200/200/200 | PLA-based matched rheology without heat-setting |
| | Sheath | Sample 4 | 50 | 115/176/185/190 | |

Those skilled in the art will recognize that the present invention is capable of many modifications and variations without departing from the scope thereof. Accordingly, the detailed description and examples set forth above are meant to be illustrative only and are not intended to limit, in any manner, the scope of the invention as set forth in the appended claims.

What is claimed is:

1. A multicomponent fiber comprising:

a. a first component having a melting temperature and comprising a first poly(lactic acid) polymer with a L:D ratio, wherein the first component forms an exposed surface on at least a portion of the multicomponent fiber; and b. a second component having a melting temperature that is at least about 10° C. greater than the melting temperature exhibited by the first component and comprising a second poly(lactic acid) polymer with a L:D ratio that is greater than the L:D ratio exhibited by the first poly(lactic acid) polymer.

2. The multicomponent fiber of claim 1 wherein the first poly(lactic acid) polymer has a L:D ratio that is less than about 96:4.

3. The multicomponent fiber of claim 2 wherein the second poly(lactic acid) polymer has a L:D ratio that is at least about 98:2.

4. The multicomponent fiber of claim 1 wherein the second poly(lactic acid) polymer has a L:D ratio that is at least about 96:4.

5. The multicomponent fiber of claim 1 wherein the second poly(lactic acid) polymer has a L:D ratio that is at least about 98:2.

6. The multicomponent fiber of claim 1 wherein the first poly(lactic acid) polymer is present in the first component in an amount that is greater than about 90 weight percent.

7. The multicomponent fiber of claim 1 wherein the second poly(lactic acid) polymer is present in the second component in an amount that is greater than about 90 weight percent.

8. The multicomponent fiber of claim 1 wherein the second component has a melting temperature that is at least about 20° C. greater than the melting temperature exhibited by the first component.

9. The multicomponent fiber of claim 1 wherein the second component has a melting temperature that is at least about 25° C. greater than the melting temperature exhibited by the first component.

10. The multicomponent fiber of claim 1 wherein the first poly(lactic acid) polymer has a weight average molecular weight that is between about 10,000 to about 500,000.

11. The multicomponent fiber of claim 1 wherein the second poly(lactic acid) polymer has a weight average molecular weight that is between about 10,000 to about 500,000.

12. The multicomponent fiber of claim 1 wherein the first poly(lactic acid) polymer has a polydispersity index value that is between about 1 to about 10.

13. The multicomponent fiber of claim 1 wherein the second poly(lactic acid) polymer has a polydispersity index value that is between about 1 to about 10.

14. The multicomponent fiber of claim 1 wherein the first poly(lactic acid) polymer has a L:D ratio that is less than about 96:4, the first poly(lactic acid) polymer has a weight average molecular weight that is between about 10,000 to about 500,000, the first poly(lactic acid) polymer has a polydispersity index value that is between about 1 to about 10, the first poly(lactic acid) polymer is present in the first component in an amount that is greater than about 90 weight percent, the second poly(lactic acid) polymer has a L:D ratio that is at least about 98:2, the second poly(lactic acid) polymer has a weight average molecular weight that is between about 10,000 to about 500,000, the second poly (lactic acid) polymer has a polydispersity index value that is between about 1 to about 10, the second poly(lactic acid) polymer is present in the second component in an amount that is greater than about 90 weight percent, and the second component has a melting temperature that is at least about 25° C. greater than the melting temperature exhibited by the first component.

15. A process for preparing a multicomponent fiber, the process comprising:

a. subjecting a first component to a first temperature and a first shear rate, wherein the first component has a melting temperature, exhibits an apparent viscosity value at the first temperature and the first shear rate, and comprises a first poly(lactic acid) polymer with a L:D ratio;

b. subjecting a second component to a second temperature and a second shear rate, wherein the second component has a melting temperature that is at least about 10° C. greater than the melting temperature exhibited by the first component, the second component exhibits an apparent viscosity value at the second temperature and the second shear rate and the difference between the apparent viscosity value of the first component and the apparent viscosity value of the second component is less than about 150 Pascal·seconds, and the second component comprises a second poly(lactic acid) polymer with a L:D ratio that is greater than the L:D ratio exhibited by the first poly(lactic acid) polymer; and c. adhering the first component to the second component to form a multicomponent fiber.

16. The process of claim 15 wherein the first poly(lactic acid) polymer has a L:D ratio that is less than about 96:4.

17. The process of claim 16 wherein the second poly (lactic acid) polymer has a L:D ratio that is at least about 98:2.

18. The process of claim 15 wherein the second poly (lactic acid) polymer has a L:D ratio that is at least about 96:4.

19. The process of claim 15 wherein the second poly (lactic acid) polymer has a L:D ratio that is at least about 98:2.

20. The process of claim 15 wherein the first poly(lactic acid) polymer is present in the first component in an amount that is greater than about 90 weight percent.

21. The process of claim 15 wherein the second poly (lactic acid) polymer is present in the second component in an amount that is greater than about 90 weight percent.

22. The process of claim 15 wherein the second component has a melting temperature that is at least about 20° C. greater than the melting temperature exhibited by the first component.

23. The process of claim 15 wherein the second component has a melting temperature that is at least about 25° C. greater than the melting temperature exhibited by the first component.

24. The process of claim 15 wherein the first poly(lactic acid) polymer has a weight average molecular weight that is between about 10,000 to about 500,000.

25. The process of claim 15 wherein the second poly (lactic acid) polymer has a weight average molecular weight that is between about 10,000 to about 500,000.

26. The process of claim 15 wherein the first poly(lactic acid) polymer has a polydispersity index value that is between about 1 to about 10.

27. The process of claim 15 wherein the second poly (lactic acid) polymer has a polydispersity index value that is between about 1 to about 10.

28. The process of claim 15 wherein the first poly(lactic acid) polymer has a L:D ratio that is less than about 96:4, the first poly(lactic acid) polymer has a weight average molecular weight that is between about 10,000 to about 500,000, the first poly(lactic acid) polymer has a polydispersity index value that is between about 1 to about 10, the first poly(lactic acid) polymer is present in the first component in an amount that is greater than about 90 weight percent, the second poly(lactic acid) polymer has a L:D ratio that is at least about 98:2, the second poly(lactic acid) polymer has a weight average molecular weight that is between about 10,000 to about 500,000, the second poly(lactic acid) polymer has a polydispersity index value that is between about 1 to about 10, the second poly(lactic acid) polymer is present in the second component in an amount that is greater than about 90 weight percent, and the second component has a melting temperature that is at least about 25° C. greater than the melting temperature exhibited by the first component.

29. The process of claim 15 wherein the difference between the apparent viscosity value of the first poly(lactic acid) polymer and the apparent viscosity value of the second poly(lactic acid) polymer is less than about 100 Pascal·seconds.

* * * * *